US009063448B2

(12) United States Patent
Hamaguchi et al.

(10) Patent No.: US 9,063,448 B2
(45) Date of Patent: Jun. 23, 2015

(54) ELECTROPHOTOGRAPHIC PHOTOCONDUCTOR AND IMAGE FORMING APPARATUS

(71) Applicant: Konica Minolta, Inc., Tokyo (JP)

(72) Inventors: Shinichi Hamaguchi, Hino (JP); Tomoo Sakimura, Hino (JP); Mayuko Matsusaki, Hino (JP); Hiroshi Nakahara, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 19 days.

(21) Appl. No.: 13/946,242

(22) Filed: Jul. 19, 2013

(65) Prior Publication Data

US 2014/0038094 A1 Feb. 6, 2014

(30) Foreign Application Priority Data

Aug. 6, 2012 (JP) ..... 2012-174374

(51) Int. Cl.
*G03G 5/14* (2006.01)

(52) U.S. Cl.
CPC ..... *G03G 5/142* (2013.01); *G03G 5/144* (2013.01)

(58) Field of Classification Search
CPC ..... G03G 5/144
USPC ..... 430/60, 63, 65
See application file for complete search history.

(56) References Cited

U.S. PATENT DOCUMENTS

| | | | | |
|---|---|---|---|---|
| 7,897,312 | B2 * | 3/2011 | Itami | 430/60 |
| 2001/0019804 | A1 * | 9/2001 | Kurihara et al. | 430/60 |
| 2001/0044063 | A1 * | 11/2001 | Hamaguchi et al. | 430/63 |
| 2005/0164105 | A1 * | 7/2005 | Shibata et al. | 430/60 |
| 2006/0188798 | A1 * | 8/2006 | Tokutake et al. | 430/60 |

FOREIGN PATENT DOCUMENTS

| | | | |
|---|---|---|---|
| JP | 2002156773 | A * | 5/2002 |
| JP | 2002-236381 | A | 8/2002 |
| JP | 2002333732 | A * | 11/2002 |
| JP | 2002357913 | A * | 12/2002 |
| JP | 2003066639 | A * | 3/2003 |
| JP | 2003207918 | A * | 7/2003 |
| JP | 2005-134924 | A | 5/2005 |
| JP | 2007-094226 | A | 4/2007 |
| JP | 2007286484 | A * | 11/2007 |
| JP | 2008096664 | A * | 4/2008 |

OTHER PUBLICATIONS

English language machine translation of JP 2008-096664 (Apr. 2008).*
English language machine translation of JP 2002-156773 (May 2002).*
English language machine translation of JP 2002-357913 (Dec. 2002).*
English language machine translation of JP 2007-286484 (Nov. 2007).*
English language machine translation of JP 2003-066639 (Mar. 2003).*
English language machine translation of JP 2002-333732 (Nov. 2002).*
English language machine translation of JP 2003-207918 (Jul. 2003).*
Borsenberger, Paul M. et al. Organic Photoreceptors for Imaging Systems. New York:Marcel-Dekker, Inc. (1993) pp. 6-17.*

* cited by examiner

*Primary Examiner* — Christopher Rodee
(74) *Attorney, Agent, or Firm* — Lucas & Mercanti, LLP

(57) ABSTRACT

The present invention provides an electrophotographic photoconductor including an electrically conductive substrate, an intermediate layer, and a photosensitive layer that are formed on the electrically conductive support, the intermediate layer including first titanium oxide particles surface-treated with a first reactive organic silicon compound, second titanium oxide particles surface-treated with a second reactive organic silicon compound different from the first reactive organic silicon compound, and a binder resin. The first reactive organic silicon compound is methyl hydrogen polysiloxane. The second reactive organic silicon compound is a compound represented by the following general formula (1):

$$R—Si—(X)_3 \quad (1)$$

R represents a alkyl group having 1 to 10 carbon atoms substituted by at least one of acryloxy and methacryloxy groups or unsubstituted; and X represents an alkoxy group having 1 to 4 carbon atoms or a halogen atom.

6 Claims, 2 Drawing Sheets

ELECTROPHOTOGRAPHIC PHOTOCONDUCTOR AND IMAGE FORMING APPARATUS

CROSS-REFERENCE TO RELATED APPLICATION

This application is based on Japanese Patent Application No. 2012-174374 filed on Aug. 6, 2012, the contents of which are incorporated herein by reference.

BACKGROUND

1. Technical Field

The present invention relates to an electrophotographic photoconductor used in an image forming method of an electrophotographic system and to an image forming apparatus provided with the electrophotographic photoconductor.

2. Description of Related Arts

In recent years, image forming apparatuses such as electrophotographic copiers and printers have been required to have higher image quality. Specific examples of requirements for high quality include improvement in image uneven density on individual pages or between pages. In image forming apparatuses, detectability has been improved, accompanied with increased quality and resolution of images formed, and the improvement leads to increased occurrence of image uneven density. In order to improve uneven density in image forming apparatuses, various attempts have conventionally been made but further research is still underway.

Recently, an electrophotographic photoconductor (hereinafter referred to also simply as "photoconductor") having a laminated structure which is negatively charged has been used widely. In the photoconductor, usually, an intermediate layer and a photosensitive layer that includes a charge generation layer and a charge transport layer formed thereon are laminated on an electrically conductive support. In the electrophotographic photoconductor having such a negatively charged type laminated structure, When the surface is negatively charged and thereafter exposed to light, the charge generation layer generates charges, of which negative charges (electrons) move to the electrically conductive support through the intermediate layer, whereas positive charges (positive holes) move to the surface of the electrophotographic photoconductor through the charge transport layer to cancel negative charges on the surface thereof, thereby forming an electrostatic latent image. Thus, it is desired that the intermediate layer has electron transport property (to allow electrons generated in the charge generation layer to rapidly move to the electrically conductive support) and positive-hole blocking property (to suppress the injection of positive holes from the electrically conductive support to the photosensitive layer).

For achievement of such functions in an intermediate layer, there are known techniques of using an intermediate layer that includes specific metal oxide particles. The techniques have attempted to improve the functions of an intermediate layer and reduce image defects such as uneven density.

For example, as a conventional attempt to reduce image defects, a following conventional technique is known: an under coat layer is composed of titanium oxide particles surface-treated with methyl hydrogen polysiloxane and a photosensitive layer includes titanyl phthalocyanine as a charge generation layer (see Patent Literature 1 below). Patent Literature 1 has reported that the uses of the titanium oxide particles subjected to the specific surface treatment and the specific charge generating material could improve image characteristics and electrical characteristics and could enhance the preservation stability of dispersion liquid, particularly under environments ranging from high temperature with high humidity to low temperature with low humidity.

As another attempt to reduce image defects such as fogging under high temperature and high humidity conditions, there is known a conventional technique in which a titanium oxide-containing intermediate layer is controlled to be in a specific range of reflection absorbance (see Patent Literature 2 below). Patent Literature 2 has described use of titanium oxide coated with an organic silicon compound, thereby water-absorbing properties and dispersibility of titanium oxide were improved.

As another attempt of conventional art to reduce image defects such as fogging and black spots, a following electrophotographic photoconductor is known: an intermediate layer is formed by including n-type semiconductor fine particles and a binder resin, where the n-type semiconductor fine particles are surface-treated a plurality of number of times and the final surface treatment is performed by using a reactive organic silicon compound (see Patent Literature 3 below).

Patent Literature 1: Japanese Laid-Open Patent Publication No. 2005-134924

Patent Literature 2: Japanese Laid-Open Patent Publication No. 2007-094226

Patent Literature 3: Japanese Laid-Open Patent Publication No. 2002-236381

SUMMARY

The uneven density described above has been known to be associated with the electrical stability of an electrophotographic photoconductor. This is because that a long-term use of an electrophotographic photoconductor gradually increases surface potential thereof, thereby causing uneven density. In order to improve uneven density, as a solution in an intermediate layer, a simple idea to increase the electron transport property of the intermediate layer is suggested. However, merely increasing the electron transport property thereof is not sufficient to suppress the injection of positive holes from an electrically conductive support to a photosensitive layer. In other words, sufficient positive-hole blocking property cannot be obtained. Additionally, there occurs leakage of carriers generated by thermal excitation in the electrophotographic photoconductor, whereby the surface potential of the photoconductor is partially reduced, causing image defects such as black spots and fogging.

Therefore, there is a trade-off relationship between the reduction of image defects such as black spots and fogging and the electrical stability of the electrophotographic photoconductor. In this respect, it has been found that, although the above conventional techniques effectively reduced image defects, electrical stability was not sufficient. Whereas, although electrical stability has been taken into consideration, image defect reduction was still insufficient. Particularly, there has been a desire for higher quality image formation in recent years, and therefore, the electrical stability of an electrophotographic photoconductor is becoming important for higher image quality.

The present invention has been accomplished in view of the above circumstances. It is an object of the invention to provide an electrophotographic photoconductor that suppresses the occurrence of image defects such as black spots and fogging in a formed image and can maintain electrical stability over a long-term use to allow improvement in uneven density, and an image forming apparatus using the same.

The object of the present invention is achieved by the following constitutions.

To achieve at least one of the above-mentioned objects, an electrophotographic photoconductor reflecting one aspect of the present invention comprises an intermediate layer and a photosensitive layer that are formed on an electrically conductive support, the intermediate layer comprising:

first titanium oxide particles surface-treated with a first reactive organic silicon compound, the first reactive organic silicon compound being methyl hydrogen polysiloxane;

second titanium oxide particles surface-treated with a second reactive organic silicon compound different from the first reactive organic silicon compound, the second reactive organic silicon compound being a compound represented by the following general formula (1):

$$R—Si—(X)_3 \quad (1)$$

wherein R represents a alkyl group having 1 to 10 carbon atoms substituted by at least one of acryloxy and methacryloxy groups or unsubstituted; and X represents an alkoxy group having 1 to 4 carbon atoms or a halogen atom; and a binder resin.

In the above described electrophotographic photoconductor, the first titanium oxide particles are preferably surface-treated with an inorganic oxide and further surface-treated with the first reactive organic silicon compound.

In the above described electrophotographic photoconductor, the second reactive organic silicon compound is preferably at least one of 3-methacryloxy propyl trimethoxysilane and 3-acryloxy propyl trimethoxysilane.

In the above described electrophotographic photoconductor, the binder resin is polyamide resin.

Figure 1:
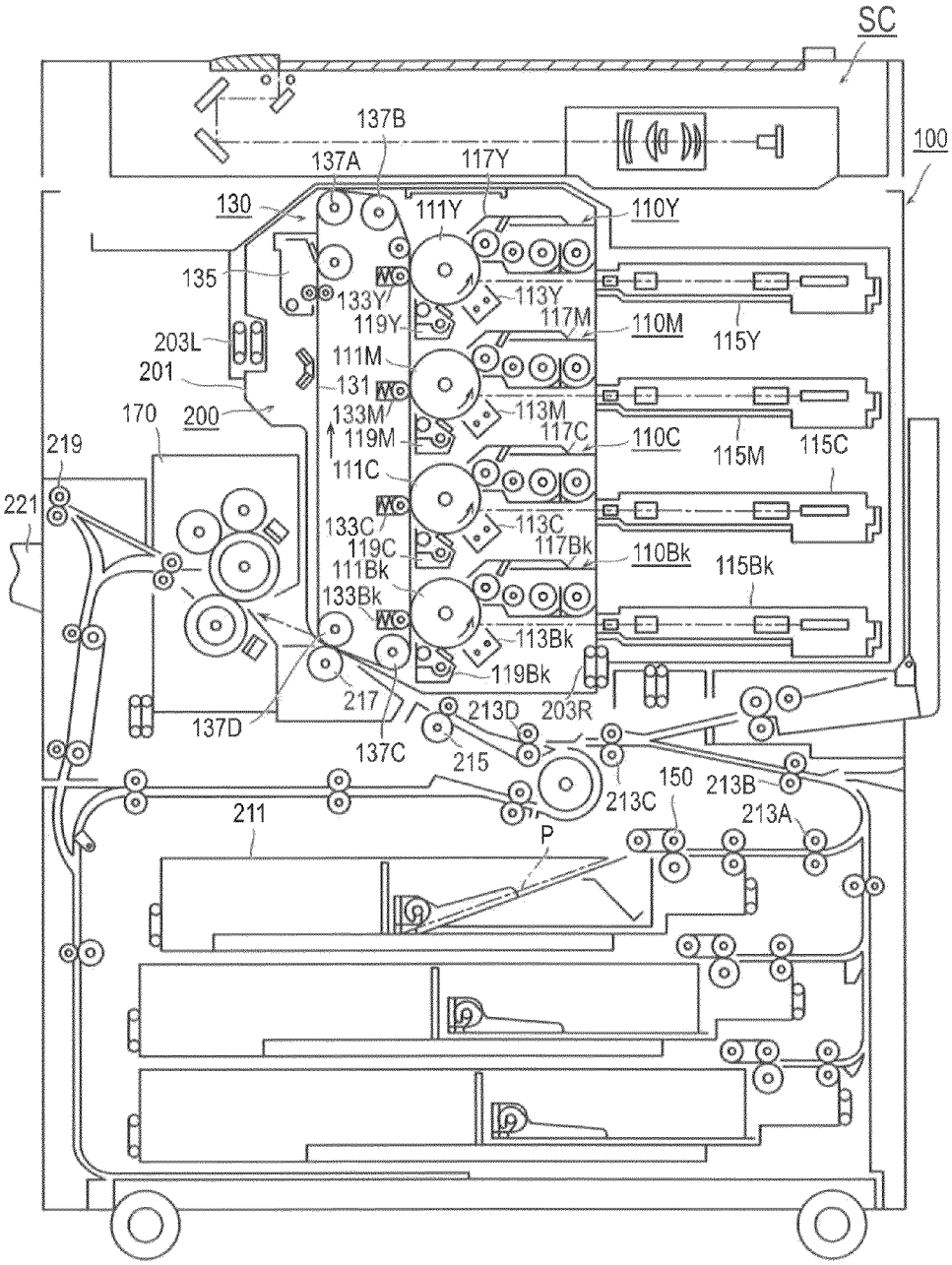
FIG. 1 is a schematic cross-sectional view illustrating an image forming apparatus according to an embodiment of the present invention.

In the FIG. 1, symbol 100 stands for an image forming apparatus substrate; 110Y, 110M, 110C, 110Bk for image forming units; 111Y, 111M, 111C, 111Bk for electrophotographic photoconductors, 113Y, 113M, 113C, 113Bk for charging means; 115Y, 115M, 115C, 115Bk for light exposing means; 117Y, 117M, 117C, 117Bk for developing means; 119Y, 119M, 119C, 119Bk for cleaning means; 130 for an endless belt-shaped intermediate transfer unit; 231 for endless belt-shaped intermediate transfer member; 133Y, 133M, 133C, 133Bk for primary transfer rollers (transfer means); 135 for cleaning means; 137A, 137B, 137C, 137D for rollers; 150 for a paper conveying means; 170 for a fuser means; 200 for process cartridges; 201 for a casing; 203R, 203L for support rails; 211 for a paper feeding cassette; 213A, 213B, 213C, 213D for intermediate rollers; 215 for a a registration roller; 217 for secondary transfer roller; 219 for paper output rollers; 221 for paper output tray; D for a rotation axis direction of the electrophotographic photoconductor; P for a transfer material; and SC for a document image reading device.

DETAILED DESCRIPTION

The present invention will be described in detail hereinbelow.

<Constitution of Electrophotographic Photoconductor>

(Layer Construction of Electrophotographic Photoconductor)

An electrophotographic photoconductor according to an embodiment of the present invention is a negative-charge type electrophotographic photoconductor including an electrically conductive support, an intermediate layer laminated on the support, and a photosensitive layer laminated on the intermediate layer.

In the electrophotographic photoconductor according to the invention, the photosensitive layer has a function of generating charge s by exposure to light and a function of transporting the generated charge (positive holes) to a surface of the photoconductor. The photosensitive layer may have a single layer structure in which both the charge generation function and the charge transport function are performed by the same layer or a laminated structure in which the charge generation function and the charge transport function are per formed by different layers. However, in order to suppress residual potential increase due to repeated use, the photosensitive layer preferably has a laminated structure of a charge generation layer and a charge transport layer. The electrophotographic photoconductor of the invention may further include a protection layer formed on the photosensitive layer.

The layer construction of the electrophotographic photoconductor of the embodiment of the invention is not particularly limited. Specific examples of the layer construction thereof include layer constructions (1) and (2) as follows:

(1) A layer construction in which the intermediate layer is laminated on the electrically conductive support, on the intermediate layer a photosensitive layer that has a laminated structure is laminated and in the structure a charge generation layer including a charge generating material and a charge transport layer including a charge transporting material are laminated in this order, so that the charge transport layer is an outermost surface layer; and (2) A layer construction in which the intermediate layer is laminated on the electrically conductive support, on the intermediate layer a photosensitive layer that has a single layer structure is laminated, and the structure includes a charge generating material and a charge transporting material, so that the photosensitive layer (single layer) is an outermost surface layer.

In the present invention, preferably, the electrophotographic receptor is formed such that at least one of the charge generation function and the charge transport function is carried out by an organic compound. The scope of the present invention encompasses all known electrophotographic photoconductors, such as a photoconductor including a photosensitive layer composed of a known organic charge-generating material or organic charge-transporting material and a photoconductor including a photosensitive layer in which a charge generation layer and a charge transport layer are each composed of a polymer complex.

As described above, the electrophotographic photoconductor according to an aspect of the present invention includes an intermediate layer including first and second titanium oxide particles surface-treated with mutually different reactive organic silicon compounds. Thereby, the occurrences of image defects such as black spots and fogging in a formed image can be suppressed, as well as image uneven density can be improved because electrical stability of the electrophotographic photoconductor can be maintained over a long-term period.

Hereinafter, a description will be given of an electrophotographic photoconductor according to the present invention having the above preferable layer structure (1). In an electrophotographic photoconductor having the layer construction (1), a photosensitive layer formed by laminating a charge generation layer and a charge transport layer in this order is formed on an electrically conductive support via an intermediate layer. When the surface of electrophotographic photoconductor is negatively charged and then exposed to light, charges are generated in the charge generation layer. Of the charges generated therein, negative charges (electrons) move through the intermediate layer to the electrically conductive support, whereas positive holes move through the charge transport layer to the surface of the electrophotographic photoconductor to cancel the negative charges on the electrophotographic photoconductor surface, resulting in the formation of an electrostatic latent image on the electrophotographic photoconductor surface. The present invention is characterized in that the intermediate layer includes first titanium oxide particles and second titanium oxides that are surface-treated with mutually different reactive organic silicon compounds. With the structure, the electron transport property can be maintained and injections of error electrons and positive holes can be suppressed in the intermediate layer, so that the occurrence of image defects such as black spots and fogging can be suppressed and electrical stability of the electrophotographic photoconductor can be improved.

Next, a description will be given of respective materials constituting the electrically conductive layer, the intermediate layer, and the photosensitive layer provided with the charge generation layer and the charge transport layer.

<Electrically Conductive Support>

The electrically conductive support constituting the electrophotographic photoconductor of the present invention can be any as long as the support is cylindrical or sheet-shaped and electrically conductive. Examples of the electrically conductive support include a drum or sheet-shaped molded body made of a metal such as aluminum, copper, chromium, nickel, zinc, or stainless steel, a plastic film with a metal foil of aluminum, copper, or the like laminated thereon, a plastic film with aluminum, indium oxide, tin oxide, or the like deposited thereon, and a metal, a plastic film, paper or the like provided with an electrically conductive layer formed by coating an electrically conductive material alone or in combination with a binder resin.

<Intermediate Layer>

In the electrophotographic photoconductor of the present invention, an intermediate layer is provided between the electrically conductive support and the photosensitive layer. The intermediate layer includes first titanium oxide particles surface-treated with a first reactive organic silicon compound, second titanium oxide particles surface-treated with a second reactive organic silicon compound different from the first reactive organic silicon compound, and a binder resin.

The reason that the electrophotographic photoconductor of the embodiment can achieve both image defect suppression and electrical stability is assumed as follows, although details are unknown. Since the intermediate layer includes the first and the second titanium oxide particles surface-treated with mutually different first and second reactive organic silicon compounds, it is assumed that relative orientations between the binder resin and the titanium oxide particles, namely, the mutual positional relationship therebetween can be controlled. When the intermediate layer has been formed by mixing the first and the second titanium oxide particles, the first and the second titanium oxide particles are supposed to be evenly dispersed in the intermediate layer immediately after the formation of the intermediate layer. However, during a drying step, the particles are supposed to move around respectively, with the result that the respective particles are differently localized in the intermediate layer completed. The titanium oxide particles subjected to mutually different surface treatments seem to have mutually different functions in the intermediate layer. Thus, the uneven localization of such particles is supposed to effectively suppress the injection of positive holes (carriers) from the charge generation layer to suppress the f image defects such as black spots and fogging, as well as supposed to contribute to the maintaining of electron transport property in the entire intermediate layer so as to be effective in maintaining electrical stability and suppressing image uneven density. However, the mechanism described above is an assumption and does not limit the scope of the present invention.

According to experiments by the present inventors, it has been shown that the advantageous effects of the present invention can be obtained by using first titanium oxide particles and second titanium oxide particles surface-treated with first and second reactive organic silicon compounds. In the present invention, a first reactive organic silicon compound that can be used as surface treatment agent is methyl hydrogen polysiloxane and a second reactive organic silicon compound is a silane compound represented by the following general formula (1).

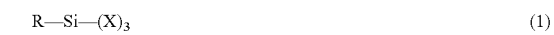

$$R—Si—(X)_3 \quad (1)$$

In the general formula (1), R represents a alkyl group having 1 to 10 carbon atoms substituted by at least one of acryloxy and methacryloxy groups or unsubstituted, and X represents an alkoxy group having 1 to 4 carbon atoms.

More specifically, examples of the second reactive organic silicon compounds include alkoxy silanes such as 3-methacryloxypropyl trimethoxysilane, 3-methacryloxypropyl triethoxysilane, 3-acryloxypropyl trimethoxysilane, 3-acryloxypropyl triethoxysilane, 2-methacryloxyethyl trimethoxysilane, 3-methacryloxybutyl trimethoxysilane. The second reactive organic silicon compounds may include two or more of these compounds.

Methyl hydrogen polysiloxane is a polysiloxane that includes a structural unit of a methyl hydrogen siloxane unit —$(HSi(CH_3)O$—, and preferably is a copolymer with other siloxane structural unit(s) than that. Examples of the other siloxane unit(s) include a dimethyl siloxane unit, a methylethyl siloxane unit, a methylphenyl siloxane unit, and a diethyl siloxane unit, and two or more siloxane units thereof may be included. Polymers including a methyl hydrogen siloxane unit(s) preferably have a molecular weight of from 1,000 to 20,000, since such polymers exhibit high surface treatment effect and consequently contribute to the suppression of image defects such as black spots.

Above all, as second reactive organic silicon compound that can more easily achieve the intended advantageous effects of the present invention, more preferred are at least one of 3-methacryloxypropyl trimethoxysilane and 3-acryloxypropyl trimethoxysilane. 3-acryloxypropyl trimethoxysilane is particularly preferable.

The first and the second titanium oxide particles may be additionally subjected to other surface treatment. Examples of the other surface treatment include an inorganic surface treatment using a surface treatment of an inorganic oxide(s) and an organic treatment using a surface treatment agent of other organic compound(s) than reactive organic silicon compounds.

Examples of the inorganic oxide(s) used as the surface treatment agent include inorganic oxides such as alumina, silica, zirconia, and hydrates thereof. Among them, particularly preferred are alumina, silica, a combination of alumina and silica because the inorganic oxides can more easily achieve the intended advantageous effects of the invention. These may be used alone or in combination of two or more thereof.

An example of the surface treatment using other organic compound(s) is a surface treatment using an organic titanium compound(s). Examples of the organic titanium compound(s) include alkoxytitanium (i.e. titaniumalkoxide), a titanium polymer, titanium acrylate, titanium chelate, tetrabutyl titanate, tetraoctyl titanate, isopropyl triisostearoyl titanate, isopropyl tridecylbenzene sulfonyl titanate, and bis (dioctylpyrophosphate)oxy acetate titanate.

In the present invention, as one of the first and the second titanium oxide particles, it is preferable to use titanium oxide particles produced by performing inorganic surface-treating titanium oxide particles then additionally performing a surface treatment using a first or a second reactive organic silicon compound. With the surface treatment of titanium oxide particles, active hydroxyl groups on surfaces of the titanium oxide particles are coated to suppress unnecessary activity. Particularly, performing the organic surface treatment in addition to the inorganic surface treatment can further ensure the coating of the hydroxyl groups on the particle surfaces, greatly reducing unnecessary activity. Above all, preferred is a combination of a surface treatment with silica and/or alumina followed by a surface treatment with a polysiloxane compound, and more preferred is a combination of titanium oxide particles subjected to such a surface treatment and titanium oxide particles subjected to only the above-mentioned surface treatment with a silane compound. Using the combination of such particles facilitates the achievement of the intended advantageous effects of the present invention.

The presence or absence of surface treatment on the titanium oxide particles included in the intermediate layer can be detected by checking the manufacturing steps or performing inorganic analysis of the surfaces of the titanium oxide particles included in the intermediate layer using a transmission electron microscopy-energy dispersive X-ray spectroscopy (TEM-EDX) or wavelength dispersive X-ray spectroscopy (WDX).

In the present invention, when both the first and the second titanium oxide particles are included in the intermediate layer, the intended advantageous effects can be obtained, and therefore the mixing ratio between the first and the second titanium oxide particles is not particularly limited. However, regarding the mixing ratio therebetween, preferably, a volume ratio of (the first titanium oxide particles:the second titanium oxide particles) is from 20:80 to 70:30, and more preferably from 30:70 to 70:30. When the mixing ratio is within the above range, the advantageous effects of suppressing image defects and maintaining electrical stability in the present invention can be further ensured.

Both the first and the second titanium oxide particles have a number average primary particle diameter of from 5 to 100 nm preferably, and more preferably from 10 to 50 nm. When the number average primary particle diameter of the titanium oxide particles is within the above range, good electron transport property is obtained and dispersibility can be maintained. Accordingly, the occurrence of image defects such as black spots and fogging can be sufficiently suppressed and the occurrence of uneven density can be sufficiently suppressed. As titanium oxide particles constituting the first and the second titanium oxide particles, it is preferable to use the same titanium oxide particles or those having the same diameter, in terms of cost, etc. However, titanium oxide particles having different particle diameters may be used.

In the present invention, the number average primary particle diameter of the titanium oxide particles is measured as follows. Specifically, a TEM (transmission electron microscope) image of the titanium oxide particles is observed at 100,000 magnifications to randomly select 100 particles as primary particles. Then, an average Feret diameter of the primary particles is measured by image analysis to obtain an average value thereof as "number average primary particle diameter".

The surface treatment of the titanium oxide particles using the first and the second reactive organic silicon compounds can be performed by a known method and is not particularly limited. The surface treatment may be a wet treatment or a dry treatment. As an example of the dry treatment, a solution of a reactive organic silicon compound dissolved in alcohol or the like is sprayed onto titanium oxide particles dispersed to be a cloud state by stirring or the like, or a gas of the reactive organic silicon compound solution is contacted with the cloud of the dispersed particles, whereby the compounds can be adhered onto the particles. Additionally, as an example of the wet surface treatment, titanium oxide particles are added to a solution of a reactive organic silicon compound dissolved or dispersed in an organic solvent and mixed together by stirring. Alternatively, titanium oxide particles may be dispersed in a solution and then a reactive organic silicon compound may be added dropwise to the dispersion liquid to adhere to the particles, followed by wet disintegration using a bead mill or the like. After that, the solvent may be distilled from the obtained solution under reduced pressure, and the resulting titanium oxide particles are subjected to annealing (bake coating). Of the treatments, wet treatment is preferable because the manufacturing process is easier and simpler.

The solvent for preparing the reactive organic silicon compound solution is preferably an organic solvent, and examples of the organic solvent include aromatic hydrocarbon-based solvents such as benzene, toluene, and xylene and ether-based solvents such as tetrahydrofuran and dioxane.

The mixing and stirring above can be performed as needed until the titanium oxide particles is sufficiently dispersed. The temperature for the above disintegration is preferably approximately from 15 to 100 degree C., and more preferably from 20 to 50 degree. The time for the disintegration is preferably from 0.5 to 10 hours, and more preferably from 1 to 5 hours. The temperature for the baking is, for example, from 100 to 220 degree C., and preferably from 110 to 150 degree C. The baking time is preferably from 0.5 to 10 hours, and more preferably from 1 to 5 hours. However, these conditions are merely one example and may vary depending on the treatment apparatuses. Accordingly, the above treatments do not necessarily have to be performed under the conditions of the above ranges.

In the wet surface treatment method, the amount of each of the first and the second reactive organic silicon compounds to be used varies depending on the kinds thereof and thus cannot be specified unconditionally. Accordingly, the amount of the compound to be used is preferably selected as needed to perform surface treatment. However, the amount of the reactive organic silicon compound that can be used is preferably from 0.1 to 20 parts by mass, and more preferably from 1 to 15 parts by mass, with respect to 100 parts by mass of untreated titanium oxide particles. The amount of the solvent to be added is preferably from 100 to 600 parts by mass, and more preferably from 200 to 500 parts by mass, with respect to 100 parts by mass of the untreated titanium oxide particles.

When the amount of the reactive organic silicon compound to be used is not less than the lower limit value, sufficient surface treatment can be performed on the untreated titanium oxide particles. As a result, since the intermediate layer can maintain the ability to block positive holes, electrical stability can be maintained and the occurrence of image defects such as black spots and fogging can be sufficiently suppressed. Meanwhile, when the amount thereof to be used is not more than the upper limit value, the reactive organic silicon compounds are allowed to react with each other, which interrupt even adhesion of a coat film onto the surfaces of the titanium oxide particles and thereby easy occurrence of leakage.

Preferably, one of the first and the second titanium oxide particles is subjected to an inorganic surface treatment before the surface treatment using the reactive organic silicon compound. For the inorganic surface treatment, the following method may be employed. Specifically, titanium oxide particles are dispersed in a solvent such as water and stirred to be suspension. The concentration of the dispersion liquid is not particularly limited as long as the entire particle surfaces can be surface-treated, but preferably, the concentration of the titanium oxide particles is from 0.1 to 20% by mass. Sodium hydroxide or the like is added to the obtained suspension for the sake of adjusting the pH to preferably 8.0 or more. Next, as a precursor solution, a silicate solution or the like for silica treatment or an aluminate solution or the like for alumina treatment is added to the dispersion liquid, and the mixed solution is heated to preferably from 60 to 100 degree C. Regarding the amount of the inorganic surface treatment agent to be added, the amount of an inorganic oxide is preferably from 1 to 20% by mass with respect to the amount of the titanium oxide particles. After that, acid is added dropwise over from 0.5 to 5 hours to allow the pH to be acidic so as to neutralize the solution. The resulting surface-treated titanium oxide particles is filtered, washed, and dried to be completed. However, the above-described treatment method is merely one example and the conditions do not necessarily have to be used.

Titanium oxide particles surface-treated with an inorganic oxide may be selected from commercially available products, such as titanium oxide particles subjected to silica and/or alumina treatment. Examples of such commercially products include T-805 (manufactured by Nippon Aerosil Co., Ltd., STT-30A and STT-653-S (Titan Kogyo K.K.), TAF-500T and TAF-1500T (manufactured by Fuji Titanium Industry Co., Ltd.), MT-100S, MT-100T, MT-100SA, and MT-500SA (manufactured by Tayca Corporation), and IT-S (Ishihara Sangyo Kaisha, Ltd).

In addition, the electrophotographic photoconductor of the embodiment of the present invention can achieve the intended advantageous effects as long as the first and the second titanium oxide particles described above are included, and the intermediate layer may further include other metal oxide particles. The other metal oxide particles are not particularly limited, and may be titanium oxide particles subjected to a surface treatment different from those of the first and the second titanium oxide particles. Examples of the other metal oxide particles include fine particles of zinc oxide, alumina (aluminum oxide), silica (silicon oxide), tin oxide, antimony oxide, indium oxide, bismuth oxide, magnesium oxide, lead oxide, tantalum oxide, yttrium oxide, cobalt oxide, copper oxide, manganese oxide, selenium oxide, iron oxide, zirconium oxide, germanium oxide, niobium oxide, molybdenum oxide, and vanadium oxide, respectively, tin-doped indium oxide, antimony-doped tin oxide, and antimony-doped zirconium oxide, respectively. These metal oxide particles may be used alone or in combination of two or more thereof.

(Binder Resin)

Examples of the binder resin constituting the intermediate layer (hereinafter may be also referred to as "intermediate layer binder resin") include polyamide resin, vinyl chloride resin, vinyl acetate resin, casein, polyvinyl alcohol resin, polyurethane resin, nitrocellulose, an ethylene-acrylic acid copolymer, and gelatin. Among them, preferred is polyamide resin from the viewpoint of suppressing dissolution of the intermediate layer when applying a coating liquid to form the charge generation layer described below on the intermediate layer. Since the surface-treated first and second titanium oxide particles described above are suitably dispersed in an alcohol-based solvent, more preferred is a an alcohol-soluble polyamide resin, such as a methoxymethylol polyamide resin.

The intermediate layer has a film thickness of preferably from 0.5 to 15 μm, and more preferably from 1 to 7 μm. When the film thickness of the intermediate layer is 0.5 μm or more, coating of the entire surface of the electrically conductive support can be ensured, so that the injection of positive holes from the electrically conductive support can be sufficiently blocked, thereby sufficiently suppressing the occurrence of image defects such as black spots and fogging. Meanwhile, when the film thickness thereof is 15 μm or less, electric resistance is small and thus sufficient electron transport property can be obtained. Accordingly, electrical stability can be maintained and the occurrence of image uneven density can be sufficiently suppressed.

<Photosensitive Layer>

The photosensitive layer constituting the photoconductor of the present invention more preferably has a layer structure in which the function of the photosensitive layer is separated into a charge generation layer (CGL) and a charge transport layer (CTL), other than a single layer structure in which both a charge generation function and a charge transport function are given to a single layer. Using the layer structure of the functionally separated type as above is advantages because residual potential increase due to repeated use can be controlled to be small and also various electrophotographic characteristics can be easily controlled in accordance with the purposes. A negative charge photoconductor has a structure in which a charge generation layer is provided on an intermediate layer and a charge transport layer is provided on the charge generation layer. Meanwhile, in a positive charge photoconductor, a charge transport layer is provided on a intermediate layer, and a charge generation layer is provided on the charge transport layer. The layer structure of a preferable photosensitive layer is the functionally separated structure described above of the negative charge photoconductor.

Hereinafter, a description will be given of, as a preferable specific example of the photosensitive layer, a photosensitive layer of the functionally separated type negative charge photoconductor, namely, a photosensitive layer including a charge generation layer and a charge transport layer laminated thereon.

(Charge Generation Layer)

The charge generation layer formed in the present invention preferably includes a charge generating material and a charge generation layer binder resin. Preferably, the charge generation layer is formed by applying a coating liquid of the charge generating material dispersed in a binder resin solution.

Examples of the charge generating material include azo pigments such as Sedan red and Diane Blue, quinone pigments such as pyrene quinone and anthanthrone, quinocyanine pigments, perylene pigments, indigo pigments such as indigo and thioindigo, and phthalocyanine pigments, although not limited thereto. Preferred are titanyl phthalocyanine pigments. These charge generating materials may be used alone or in combination of two or more thereof.

The charge generating material can be selected from those mentioned above according to sensitivity to the oscillation wavelength of an exposing light source. In order to increase the sensitivity to the oscillation wavelength of an exposing light source in a digital copier, phthalocyanine pigments are preferable. An example of a preferable phthalocyanine pigment used to increase sensitivity to the oscillation wavelength of an exposing light source, such as a wavelength of 780 nm is a Y-type titanyl phthalocyanine pigment or a mixture of a titanyl phthalocyanine pigment and a butanediol-added titanyl phthalocyanine pigment, particularly, 2,3-butanediol-added titanyl phthalocyanine pigment.

(Charge Generation Layer Binder Resin)

As the charge generation layer binder resin, a known resin may be used. Examples of the known resin include polystyrene resin, polyethylene resin, polypropylene resin, acrylic resin, methacrylic resin, vinyl chloride resin, vinyl acetate resin, polyvinyl butyral resin, epoxy resin, polyurethane resin, phenolic resin, polyester resin, alkyd resin, polycarbonate resin, silicone resin, melamine resin, copolymers including two or more of these resins (e.g. vinyl chloride-vinyl acetate copolymer and vinyl chloride-vinyl acetate-maleic anhydride copolymer), and polyvinyl carbazole resin, although not limited thereto. Preferred is polyvinyl butyral resin. The weight average molecular weight of the binder resin is not particularly limited, but preferably from 10,000 to 150,000, and more preferably from 15,000 to 100,000.

Regarding a mixing ratio of the charge generating material to the charge generation layer binder resin, the amount of the charge generating material mixed is preferably from 20 to 600 parts by mass, and more preferably from 50 to 500 parts by mass with respect to 100 part by mass of the charge generation layer binder resin. When the content of the charge generating material is within the above range, sufficient charges can be generated by exposure to light. Accordingly, sufficient sensitivity of the photosensitive layer (charge generation layer) can be ensured and residual potential increase due to repeated use can be prevented.

The film thickness of the charge generation layer varies depending on the characteristics of the charge generating material, the characteristics of the binder resin, the mixing ratio therebetween, and the like. However, the film thickness thereof is preferably from 0.01 to 5 μm, and more preferably from 0.05 to 3 μm.

(Charge Transport Layer)

The charge transport layer formed in the embodiment of the present invention is preferably formed with including a charge (positive hole) transporting substance and a charge transport layer binder resin. Preferably, the charge transport layer is formed by applying a coating liquid of the charge transporting material dissolved in a binder resin solution.

The charge transporting material may be a known compound. Examples of the known compound include the followings: a triarylamine derivative, a hydrazone compound, a styryl compound, a benzidine compound, a butadiene compound, a carbazole derivative, an oxazole derivative, an oxadiazole derivative, a thiazole derivative, a thiadiazole derivative, a triazole derivative, an imidazole derivative, an imidazolone derivative, an imidazolidine derivative, a bisimidazolidine derivative, a pyrazoline compound, an oxazolone derivative, a benzimidazole derivative, a quinazoline derivative, a benzofuran derivative, an acridine derivative, a fenadine derivative, an aminostilbene derivative, a phenylenediamine derivative, a stilbene derivative, poly-N-vinyl carbazol, poly-1-vinylpyrene, and poly-9-vinyl anthracene. These compounds may be used alone or in combination of two or more thereof. Among the compounds above, preferred is a triarylamine derivative.

The charge transport layer binder resin may be a known compound. Examples of the known compound include polyester resin, polystyrene resin, acrylic resin, vinyl chloride resin, vinyl acetate resin, polyvinyl butyral resin, epoxy resin, polyurethane resin, phenolic resin, alkyd resin, polycarbonate resin, silicone resin, melamine resin, a styrene-acrylnitrile copolymer, polymethacrylate ester resin, and a styrene-methacrylate ester copolymer. These may be used alone or in combination of two or more thereof. Among them, polycarbonate resin is preferable in terms of low water absorption rate and good dispersibility of the charge transporting material.

The charge transport layer may include other components, such as an antioxidant, as needed.

The content of the charge transporting material is preferably from 10 to 200 parts by mass and more preferably from 20 to 100 parts by mass, with respect to 100 parts by mass of the charge transport layer binder resin. When the content thereof is within the above range, sufficient charge transport property can be ensured. Accordingly, charges generated in the charge generation layer can be sufficiently transported to the surface of the electrophotographic photoconductor and residual potential increase due to repeated use can be prevented.

The thickness of the charge transport layer varies depending on the characteristics of the charge transporting material and the binder resin, the mixing ratio therebetween, and the like, but is preferably from 10 to 40 μm.

<Protection Layer>

The electrophotographic photoconductor of the embodiment of the present invention may further include a protection layer on the photosensitive layer. The protection layer serves to protect the photoconductor from external environment and shocks. When forming the protection layer, the protection layer preferably includes inorganic particles and a binder resin (hereinafter referred to as "protection layer binder resin"), and may include other components such as an antioxidant and a lubricant as needed.

Preferable examples of the inorganic particles included in the protection layer include particles of silica, alumina, strontium titanate, zinc oxide, titanium oxide, tin oxide, antimony oxide, indium oxide, bismuth oxide, tin-doped indium oxide, antimony-doped tin oxide, tantalum-doped tin oxide, and zirconium oxide, respectively. Particularly preferred are hydrophobic silica, hydrophobic alumina, hydrophobic zirconia, and fine powder of baked silica, etc., having hydrophobic surfaces.

The inorganic particles have preferably a number average primary particle diameter of from 1 to 300 nm preferably and particularly preferably from 5 to 100 nm.

The average number primary particle diameter of the inorganic particles is defined as a value obtained by calculating a measurement value as a number average diameter of Feret diameter by image analysis of the random observation of 300 particles as primary particles enlarged at 10,000 magnifications by a transmission electron microscope.

The protection layer binder resin may be either a thermoplastic resin or a thermosetting resin. Examples of the resin include polyvinyl butyral resin, epoxy resin, polyurethane resin, phenolic resin, polyester resin, alkyd resin, polycarbonate resin, silicone resin, and melamine resin.

Examples of the lubricant included in the protection layer include fine powders of resins (e.g. fluorine-based resin, polyolefin-based resin, silicone resin, melamine resin, urea resin, acrylic resin, and styrene resin), fine powders of metal oxides (e.g. titanium oxide, aluminum oxide, and tin oxide), solid lubricants (e.g. polytetrafluoroethylene, polychlorotrifluoroethylene, polyvinylidene fluoride, zinc stearate, and aluminum stearate), silicone oils (e.g. dimethyl silicone oil, methylphenyl silicone oil, methyl hydrogen polysiloxane, cyclic dimethylpolysiloxane, alkyl-modified silicone oil, polyether-modified silicone oil, alcohol-modified silicone oil, fluorine-modified silicone oil, amino-modified silicone oil, mercapto-modified silicone oil, epoxy-modified silicone oil, carboxyl-modified silicone oil, and higher fatty acid-modified silicone oil), fluorine-based resin powders (e.g. tetrafluoroethylene resin powder, trifluorochloroethylene resin powder, hexafluoroethylene-propylene resin powder, vinyl fluoride resin powder, vinylidene fluoride resin powder, dichloroethylene fluoride resin powder, and copolymers thereof), and polyolefin-based resin powders (e.g. homopolymer resin powders such as polyethylene resin powder, polypropylene resin powder, polybutene resin powder, and polyhexene resin powder, copolymer powders such as an ethylene-propylene copolymer and an ethylene-butene copolymer, ternary copolymers of these resins and hexene, etc., and polyolefin-based resin powders such as thermally modified products of these resins).

The molecular weight and powder particle diameter of a resin used as the lubricant are selected as needed. The particle diameter of the resin is particularly preferably from 0.1 to 10 μm. In order to evenly disperse these lubricants, a dispersant may be additionally added to the protection layer binder resin.

<Method for Manufacturing Electrophotographic Photoconductor>

The method for manufacturing the electrophotographic photoconductor of the present invention is not particularly limited. For example, a coating liquid may be prepared that can form each of the intermediate layer, the photosensitive layer including the charge generation layer and the charge transport layer or having a single layer structure, and if needed, the protection layer. Then, the coating liquids may be sequentially applied on the electrically conductive support by a known coating method and then dried to sequentially form each of the layers. Specific examples of the coating method include an immersion coating method, a spray coating met hod, a spin coating method, a bead coating method, a blade coating method, a beam coating method, and a circular amount-controlling type coating method (a coating method using a slide-hopper coater). The circular amount-controlling type coating method is described in detail in Japanese Laid-Open Patent Publication No. 983-18906, etc.

(Formation of Intermediate Layer)

The method for forming the intermediate layer is not particularly limited. For example, the following method can be used. First, a binder resin is dissolved or dispersed in a solvent. Next, to the dispersion liquid, respective first and second titanium oxide particles surface-treated with the first and the second reactive organic silicon compounds described above, respectively, are added to be evenly dispersed, thereby preparing a dispersion liquid. After that, the obtained dispersion liquid is left for approximately 24 hours and then filtered to prepare a coating liquid for forming an intermediate layer. Then, the coating liquid is applied on the electrically conductive support by any of the methods mentioned above and dried to form an intermediate layer.

In the formation of the coating liquid, the binder resin concentration can be selected as needed according to the film thickness of the intermediate layer and the coating method. The content of the solvent is preferably from 100 to 3,000 parts by mass, and more preferably 500 to 2,000 parts by mass, with respect to 100 parts by mass of the binder resin. The total concentration of the first and the second metal oxide particles is preferably from 200 to 600 parts by mass and more preferably from 200 to 500 parts by mass, with respect to 100 parts by mass of the binder resin. The composition ratio in the coating liquid is a composition ratio in the finally completed intermediate layer. In order to further ensure the intended advantageous effects of the present invention, it is also suitable to control the components of the intermediate layer by a volume ratio therebetween. In other words, the volume ratio between the total titanium oxide particles and the resin (titanium oxide particles/resin) is preferably from 5/10 to 11/10.

As a solvent usable for the formation of the intermediate layer, preferred is a solvent that gives good dispersion of metal oxide particles and dissolves a binder resin such as polyamide resin. Specifically, alcohols having 2 to 4 carbon atoms, such as ethanol, n-propyl alcohol, isopropyl alcohol, n-butanol, t-butanol, and sec-butanol, are preferable, since these alcohols exhibit good solubility and coating performance for polyamide resin preferable as the binder resin. Additionally, in order to improve preservability and dispersibility of inorganic fine particles, co-solvents as mentioned below may be used in combination with the above solvent. Examples of the co-solvents that can exert desirable effects include methanol, benzyl alcohol, toluene, cyclohexanone, and tetrahydrofuran.

Examples of means for dispersing conductive fine particles, metal oxide particles, or the like include an ultrasonic disperser, a bead mill, a ball mill, a sand grinder, and a homomixer, although not limited thereto. The occurrence of image defects can be prevented by filtering the intermediate layer coating liquid to remove foreign objects and aggregates before coating.

The method for drying a coated film of the intermediate layer coating liquid can be selected as needed from known drying methods according to the kind of the solvent and the thickness of the film to be formed. Particularly preferred is heat drying. As drying conditions, for example, heat drying can be performed at from 100 to 150 degree C. for from 10 to 60 minutes.

(Formation of Charge Generation Layer)

The formation of the charge generation layer is preferably performed as follows: a charge generating material is added to a solution of the charge generation layer binder resin dissolved in a solvent, and dispersed by a disperser or the like to prepare a coating liquid; next, the coating liquid is applied to have a constant film thickness by any of the coating methods above; and the coated film is dried to form a charge generation layer. Also in the case of forming a photosensitive layer having the single structure including a charge generating material and a charge transporting material, the photosensitive layer can be formed in the same manner as the formation of the charge generation layer.

The concentration of the charge generation layer binder resin in the charge generation layer coating liquid can be selected as needed so as to obtain a viscosity suitable for coating. Preferably, the amount of the solvent is from 100 to 5,000 parts by mass with respect to 100 parts by mass of the charge generation layer binder resin. The concentration of the charge generating material is preferably from 80 to 400 parts by mass with respect to 100 parts by mass of the charge generation layer binder resin.

Examples of the solvent for coating by dissolving the charge generation layer binder resin for the charge generation layer include toluene, xylene, methyl ethyl ketone, cyclohexanone, cyclohexane, ethyl acetate, butyl acetate, methanol, ethanol, propanol, butanol, methyl cellosolve, ethyl cellosolve, tetrahydrofuran, 1-dioxane, 1,3-dioxolane, 4-methoxy-4-methyl-2-pentanone pyridine, and diethyl amine, although not limited thereto. These organic solvents may be used alone or in combination of two or more thereof. More preferred are methyl ethyl ketone and cyclohexanone.

By filtering the coating liquid for a charge generation layer to remove foreign objects and aggregates before coating, the occurrence of image defects can be prevented. As the method for applying the coating liquid, the same method as the formation of the intermediate layer can also be employed.

(Formation of Charge Transport Layer)

The charge transport layer is preferably formed as follows: a charge transporting material is dissolved in a solution of a charge transport layer binder resin dissolved in a solvent to prepare a coating liquid; then, the coating liquid is applied so as to be a constant film thickness by any of the coating methods above; and the coated film is dried to form a charge transport layer.

The concentration of the charge transport layer binder resin in the charge transport layer coating liquid can be selected as needed so as to obtain a viscosity suitable for the above coating method to be used. The amount of the solvent is preferably from 100 to 1,000 parts by mass and more preferably from 400 to 800 parts by mass, with respect to 100 parts by mass of the charge transport layer binder resin. The concentration of the charge transporting material is preferably from 30 to 150 parts by mass and more preferably from 60 to 90 parts by mass, with respect to 100 parts by mass of the charge transport layer binder resin.

By filtering the coating liquid for a charge generation layer to remove foreign objects and aggregates before coating, the occurrence of image defects can be prevented. As the method for applying the coating liquid, the same method as the formation of the intermediate layer can also be employed.

<Formation of Protection Layer>

As the method for forming a protection layer, the same method as that for the intermediate layer etc., described above can also be employed. A coating liquid may be prepared by dispersing or dissolving components for forming a protection layer in a solvent, then applied so as to be an intended thickness by any of the above coating methods, and then dried to form a protection layer.

<Image Forming Apparatus>

An image forming apparatus according to an embodiment of the present invention includes at least the electrophotographic photoconductor of the invention.

FIG. 1 is a schematic cross-sectional view illustrating an example of a configuration of the image forming apparatus according to the embodiment of the present invention. An image forming apparatus 100 is a tandem type color image forming apparatus and includes four of image forming units 110Y, 110M, 110C, and 110Bk, an endless belt-shaped intermediate transfer unit 130, a paper conveying means 150, and a fuser means 170. Or the top of a main body of the image forming apparatus 100, a document image reading device SC is arranged.

The image forming units 110Y, 110M, 110C, and 110Bk are arranged in a vertical direction. The image forming units 110Y, 110M, 110C, and 110Bk includes electrophotographic photoconductors 111Y, 111M, 111C, and 111BK as the first image supporting members, charging means 113Y, 113M, 113C, and 113Bk sequentially arranged at peripheries of the photoconductors in a drum rotation direction, light exposing means 115Y, 115M, 115C, and 115Bk, developing means 117Y, 117M, 117C, and 117Bk, and cleaning means 119Y, 119M, 119C, and 119Bk. Then, the respective image forming units 110Y, 110M, 110C, and 110Bk are configured such that respective toner images of yellow (Y), magenta (M), cyan (C), and black (Bk) can be formed on the respective electrophotographic photoconductors 111Y, 111M, 111C, and 111Bk. The image forming units 110Y, 110M, 110C, and 110Bk have the same structure except for the difference in colors of the toner images formed on the electrophotographic photoconductors 111Y, 111M, 110C, and 111Bk. Accordingly, using an example of the image forming unit 110Y, a description of the image forming units will be given below.

The image forming unit 110Y is the electrophotographic photoconductor of the embodiment of the present invention. The intermediate layer constituting the electrophotographic photoconductor includes the first and second titanium oxide particles, respectively, surface-treated with the respective first and second reactive organic silicon compounds.

The charging means 113Y supplies a constant potential to the electrophotographic photoconductor 111Y. In the present embodiment, as the charging means 113Y, a corona discharge charger is preferably used.

The light exposing means 115Y serves to form an electrostatic latent image corresponding to a yellow image by exposing light based on an image signal (a yellow image signal) on the electrophotographic photoconductor 111Y to which a constant potential has been supplied by the charging means 113Y. The light exposing means 115Y may be composed of LEDs as light emitting elements arrayed in an axial direction of the electrophotographic photoconductor 111Y and an image forming element, or may be a laser optical system or the like.

The light source for exposure is preferably a semiconductor laser or a light emitting diode having an oscillation wavelength not less than 50% of a maximum absorbance of a charge generating material to be used. For example, when the charge generating material, to be used is a mixture of 2,3-butanediol-added titanyl phthalocyanine and non-added titanyl phthalocyanine, the oscillation wavelength of the exposure light source is preferably from 650 to 800 nm. By using such an exposing light source as above and narrowing the exposure dot diameter in a main scanning direction of writing to 10-100 μm to perform digital light exposure on the photoconductor, an electrophotographic image, which has a high resolution ranging from 600 dpi (dpi: the number of dots per 254 cm) to 24,000 dpi, or a resolution higher than that, can be formed.

The light exposure dot diameter (Ld) represents a length of an exposing beam in the main scanning direction in the region having an exposure beam intensity not less than $1/e^2$ of the peak intensity (Ld: measured at a maximum length position).

The developing means 117Y is configured to supply toner to the electrophotographic photoconductors 111Y to allow the development of an electrostatic latent image formed on a surface of the electrophotographic photoconductor 111Y.

The cleaning means 119Y may include a roller or a blade that is pressed into contact with a surface of the electrophotographic photoconductor 111Y.

The endless belt-shaped intermediate transfer unit 130 is provided in; such a manner as to come in contact with the electrophotographic photoconductors 111Y, 111M, 111C, and 111Bk. The endless belt-shaped intermediate transfer unit 130 includes an endless belt-shaped intermediate transfer member 131 as the second image supporting member, primary transfer rollers 133Y, 133M, 133C, and 133Bk arranged in contact with the endless belt-shaped intermediate transfer member 131, and a cleaning means 135 of the endless belt-shaped intermediate transfer member 131.

The endless belt-shaped intermediate transfer member 131 is wound around a plurality of rollers 137A, 137B, 137C and 137D to be rotatably supported.

In the image forming apparatus 100, the electrophotographic photoconductor 111Y, the developing means 117Y, the cleaning means 119Y, etc., may be integrally combined to form a process cartridge (image forming unit) configured detachably to the main body of the apparatus. Alternatively, the electrophotographic photoconductor 111Y may be integrally configured with one or more members selected from a group consisting of the charging means 113Y, the light exposing means 115Y, the developing means 117Y, the primary transfer roller 133Y, and the cleaning means 119Y to form a process cartridge (image forming unit).

A process cartridge 200 includes a casing 201, the electrophotographic photoconductor 111Y housed in the casing 201, the charging means 113Y, the developing means 117Y, the cleaning means 119Y, and the endless belt-shaped intermediate transfer unit 130. Support rails 203L and 203R is provided in the apparatus main body as means for guiding the process cartridge 200 into the apparatus main body, whereby the process cartridge 200 is detachable from the apparatus main body.

These process cartridges 200 may be single image forming unit configured detachably to the apparatus main body.

The paper conveying unit 150 is provided in such a manner as to convey a transfer material P in a paper feeding cassette 211 to a secondary transfer roller 217 through a plurality of intermediate rollers 213A, 213B, 213C, and 213D and a registration roller 215.

The fuser means 170 performs the fusing process of a color image transferred by the secondary transfer roller 217. Paper output rollers 219 are provided in such a manner as to sandwich the transfer material P subjected to the fusing process to place on a paper output tray 221 provided outside the image forming apparatus.

In the image forming apparatus 100 thus configured, image is formed by the image forming units 100Y, 111M, 110C, and 110BK. Specifically, the charging means 113Y, 113M, 113C, and 113Bk apply corona discharge onto the surfaces of the electrophotographic photoconductors 111Y, 111M, 111C, and 111Bk to allow the surfaces to be negatively charged. Next, the light exposing means 115Y, 115M, 115C, and 115Bk expose the surfaces of the electrophotographic photoconductors 111Y, 111M, 111C, and 111Bk to light based on image signals to form electrostatic latent images. Then, the developing means 117Y, 117M, 117C, and 117Bk apply toner onto the surfaces of the electrophotographic photoconductors 111Y, 111M, 111C, and 111Bk to develop the images.

Next, the primary transfer rollers (primary transfer means) 133Y, 133M, 133C, and 133Bk are contacted with the endless belt-shaped intermediate transfer member 131 rotating. This allows each color image formed on each of the electrophotographic photoconductors 111Y, 111M, 111C, and 111Bk to be sequentially transferred onto the rotating endless belt-shaped intermediate transfer member 131, thereby the color images are transferred (primary transfer). During the processing of image formation, the primary transfer roller 133Bk is in continuous contact with the electrophotographic photoconductor 111Bk. On the other hand, the other primary transfer rollers 133Y, 133M, and 133C come in contact with the corresponding respective electrophotographic photoconductors 111Y, 111M, and 111C only when formation of color images.

Then, the primary transfer rollers 133Y, 133M, 133C, and 133Bk are separated from the endless belt-shaped intermediate transfer member 131, and the cleaning means 119Y, 119M, 119C, and 119Bk remove toner remaining on the surfaces of the electrophotographic photoconductors 111Y, 111M, 111C, and 111Bk. Then, in order to prepare for the next image formation, a charge eliminator (not shown) eliminates charge from the surfaces of electrophotographic photoconductors 111Y, 111M, 111C, and 111Bk as need, followed by negative charging of the surfaces thereof by the charging means 113Y, 113M, 113C, and 113Bk.

On the other hand, the transfer material P (e.g. a supporting member that carries a final image, such as plain paper or a transparent sheet) housed in the paper feeding cassette 211 is fed by the paper conveying means 150 to the secondary transfer roller (secondary transfer means) 217 through the intermediate rollers 213A, 213B, 213C, and 213D, and the registration roller 215. Then, the secondary transfer roller 217 is allowed to contact with the endless belt-shaped intermediate transfer member 131 rotating, to collectively transfer the color images (secondary transfer) on the transfer material P. It is only during the secondary transfer on the transfer material P that the secondary transfer roller 217 is in contact with the endless belt-shaped intermediate transfer member 131. After that, the transfer material P with the color images collectively transferred thereon is separated at a high curvature portion of the endless belt-shaped intermediate transfer member 131.

Then, the fuser means 17 fuses the transfer material P with the color images collectively transferred thereon as described above, and next, the paper output rollers 219 sandwich the transfer material P therebetween to place in the paper output tray 221 outside the apparatus. After separating the transfer material P with the color images collectively transferred thereon from the endless belt-shaped intermediate transfer member 131, the cleaning means 135 removes toner remaining on the endless belt-shaped intermediate transfer member 131.

As described above, the intermediate layers of the electrophotographic photoconductors 111Y, 111M, 111C, and 111Bk included in the image forming apparatus 100 according to the present embodiment include the first and the second titanium oxide particles. Accordingly, since the intermediate layers have sufficient electron transport property, residual potential increase on the surfaces of the photoconductors can be suppressed and image uneven density can be reduced. Furthermore, the intermediate layers of the electrophotographic photoconductors 111Y, 111M, 111C, and 111Bk have high positive-hole blocking property. Therefore, the injection of unnecessary positive holes from the electrically conductive support and the movement of unnecessary thermally excited carriers from the charge generation layer can be reduced, thereby suppressing image defects such as black spots and fogging.

Hereinbelow, the present invention will De described in detail with reference to Examples and Comparative Examples, but the invention is not limited thereto.

EXAMPLES

The following is a detailed description of the present invention given by Examples, but the invention is not limited to only the Examples below. It is noted that the term "part(s)" used in the following Examples and Comparative Examples refers to part(s) by mass.

(Production of Surface-Treated Titanium Oxide Particles)

<Production of Surface-Treated Titanium Oxide Particles 1>

Five hundred parts by mass of inorganic surface-treated titanium oxide (MT-500SA, manufactured by Tayca Corporation) obtained by performing silica-alumina surface treatment on rutile-type titanium oxide having a number average primary particle diameter of 35 nm, 13 parts by mass of methyl hydrogen polysiloxane (MHPS, manufactured by Shin-Etsu Chemical Co., Ltd.), and 1500 parts by mass of toluene were mixed together by stirring. Then, the mixture was wet disintegrated by a bead mill for a mil retention time of 25 minutes at 35 degree C. Next, from the slurry obtained by wet disintegration, toluene was distilled under reduced pressure to separate and remove it. The resulting dry material was bake-coated with MHPS at 120 degree C. for 2 hours and then pulverized by a pin mill to obtain surface-treated titanium oxide particles 1.

<Production of Surface-Treated Titanium Oxide Particles 3>

Surface-treated titanium oxide particles 3 were produced in the same manner as the production of the surface-treated titanium oxide particles 1, except that 13 parts by mass of MHPS used in the production of the surface-treated titanium oxide particles 1 was changed to 65 parts by mass of 3-methacryloxypropyl trimethoxysilane (KBM-503, manufactured by Shin-Etsu Chemical Co., Ltd).

<Production of Surface-Treated Titanium Oxide Particles 4>

Five hundred parts by mass of inorganic surface-treated titanium oxide (MT-100SA, manufactured by Tayca Corporation) obtained by performing silica-alumina surface treatment on rutile-type titanium oxide having a number average primary particle diameter of 15 nm, 30 parts by mass of MHPS, and 1300 parts by mass of toluene were mixed together by stirring. Then, the mixture was wet disintegrated by a bead mill for a mill retention time of 40 minutes at 35 degree C. Next, from the slurry obtained by wet disintegration, toluene was distilled under reduced pressure to separate and remove it. The resulting dry substance was bake-coated with MHPS at 120 degree C. for 2 hours and then pulverized by a pin mill to obtain surface-treated titanium oxide particles 4.

<Production of Surface-Treated Titanium Oxide Particles 5>

Surface-treated titanium oxide particles 5 were produced by the same manner as the production of the surface-treated titanium oxide particles 4, except that 30 parts by mass of MHPS used in the production of the surface-treated titanium oxide particles 4 was changed to 95 parts by mass of 3-methacryloxypropyl trimethoxysilane (KBM-503, manufactured by Shin-Etsu Chemical Co., Ltd).

<Production of Surface-Treated Titanium Oxide Particles 6>

Five hundred parts by mass of rutile-type titanium oxide having a number average primary particle diameter of 35 nm was mixed and stirred with 2,000 parts by mass of toluene, then 13 parts by mass of MHPS was added thereto, followed by stirring at 50 degree C. for 3 hours. After that, toluene was removed by distillation under reduced pressure and the resulting material was bake-coated at 130 degree C. for 3 hours and then pulverized by a pin mill to obtain surface-treated titanium oxide particles 6.

<Production of Surface-Treated Titanium Oxide Particles 7>

Five hundred parts by mass of rutile-type titanium oxide having a number average primary particle diameter of 15 nm, 30 parts by mass of MHPS, and 1300 parts by mass of toluene were mixed and stirred together. Then, the mixture was wet disintegrated by a bead mill for a mill retention time of 40 minutes at 35 degree C. Next, from the slurry obtained by wet disintegration, toluene was distilled under reduced pressure to separate and remove it. The resulting dry substance was bake-coated with MHPS at 120 degree C. for 2 hours and then pulverized by a pin mill to obtain surface-treated titanium oxide particles 7.

<Production of Surface-Treated Titanium Oxide Particles 8>

Surface-treated titanium oxide particles 8 were produced by the same manner as the production of the surface-treated titanium oxide particles 7, except that 30 parts by mass of MHPS used in the production of the surface-treated titanium oxide particles 7 was changed to 100 parts by mass of 3-methacryloxypropyl trimethoxysilane (KBM-503, manufactured by Shin-Etsu Chemical Co., Ltd).

<Production of Surface-Treated Titanium Oxide Particles 9>

Surface-treated titanium oxide particles 9 were produced by the same manner as the production of the surface-treated titanium oxide particles 7, except that 30 parts by mass of MHPS used in the production of the surface-treated titanium oxide particles 7 was changed to 100 parts by mass of p-styryl trimethoxysilane.

<Production of Surface-Treated Titanium Oxide Particles 10>

Surface-treated titanium oxide particles 10 were produced by the same manner as the production of the surface-treated titanium oxide particles 7 except that 30 parts by mass of MHPS used in the production of the surface-treated titanium oxide particles 7 was changed to 90 parts by mass of 3-acryloxypropyl trimethoxysilane.

<Production of Surface-Treated Titanium Oxide Particles 11>

Seventy parts by mass of titanium oxide particles (MT-500B, manufactured by Tayca Corporation) having a number average primary particle diameter of 35 nm was dispersed in 1,000 parts by mass of water and then stirred into suspension. Sodium hydroxide was added to 5 L of the resulting aqueous suspension of the titanium oxide particles to adjust the pH to 9.0 or more. Next, an aqueous solution of silicate soda (200 g/l) in an amount: of 175 ml (including $SiO_2$ in an amount of 10% by mass with respect to the titanium oxide particles) was added. After heating the suspension to 0 degree C., sulfuric acid was added dropwise over 3 hours to neutralize the pH thereof to 6.5. The resulting solution was filtered, washed, and dried at 250 degree C. for 2 hours to obtain silica-treated titanium oxide particles 11. Subsequently, 500 parts by mass of the silica-treated titanium oxide particles, 13 parts by mass of methyl hydrogen polysiloxane (MHPS: KF-901, manufactured by Shin-Etsu Chemical Co., Ltd.) and 1,500 parts by mass of toluene were mixed and stirred together, and then, the mixture wet disintegrated by a bead mill for a mill retention time of 25 minutes at 35 degree C. Next, from the slurry obtained by the wet disintegration, toluene was distilled under reduced pressure to separate and remove it. The resulting dry substance was bake-coated with MHPS at 220 degree C. for 2 hours and then pulverized by a pin mill to complete surface-treated titanium oxide particles 11.

<Production of Surface-Treated Titanium Oxide Particles 12>

Five hundred parts by mass of anatase-type titanium oxide having a number average primary particle diameter of 30 nm, 15 parts by mass of MHPS, and 1,800 parts by mass of toluene were mixed and stir red together, and then, the mixture was wet disintegrated by a bead mill for a mill retention time of 60 minutes at 35 degree C. Next, from the slurry obtained by the wet disintegration, toluene was distilled under reduced pressure to separate and remove it. The resulting dry substance was bake-coated with MHPS at 120 degree C. for 2 hours and then pulverized by a pin mill to obtain surface-treated titanium oxide particles 12.

<Production of Surface-Treated Titanium Oxide Particles 13>

Surface-treated titanium oxide particles 13 were produced by the same manner as the production of the surface-treated titanium oxide particles 7 except that 30 parts by mass of MHPS used in the production of the surface-treated titanium oxide particles 7 was changed to 80 parts by mass of allyl trimethoxysilane (Tokyo Kasei Kogyo).

<Production of Surface-Treated Titanium Oxide Particles 14>

Surface-treated titanium oxide particles 14 were produced by the same manner as the production of the surface-treated titanium oxide particles 1 except that 13 parts by mass of MHPS used in the products 1 on of the surface-treated titanium oxide particles 1 was changed to 100 parts by mass of carboxyl modified silicone oil (X-22-3701E, manufactured by Shin-Etsu Chemical Co., Ltd).

The following Table 1 provides a summary of the surface-treated titanium oxide particles 1 to 12 obtained above. Specific gravities of the particles indicated in Table 1 were measured by a gas phase substitution method.

TABLE 1

| Surface-treated titanium oxide particles | | | | | |
|---|---|---|---|---|---|
| No. | Particle diameter/ nm | Crystal type | Inorganic surface treatment | Reactive organic silicon compound used | Specific gravity |
| 1 | 35 | Rutile | Silica/ alumina | Methyl hydrogen polysiloxane | 3.8 |
| 3 | 35 | Rutile | Silica/ alumina | 3-methacryloxypropyl trimethoxysilane | 3.8 |
| 4 | 15 | Rutile | Silica/ alumina | Methyl hydrogen polysiloxane | 3.5 |
| 5 | 15 | Rutile | Silica/ alumina | 3-methacryloxypropyl trimethoxysilane | 3.5 |
| 6 | 35 | Rutile | None | Methyl hydrogen polysiloxane | 3.6 |
| 7 | 15 | Rutile | None | Methyl hydrogen polysiloxane | 3.4 |
| 8 | 15 | Rutile | None | 3-methacryloxypropyl trimethoxysilane | 3.4 |
| 9 | 15 | Rutile | None | p-styryl trimethoxysilane | 3.3 |
| 10 | 15 | Rutile | None | 3-acryloxypropyl trimethoxysilane | 3.0 |
| 11 | 35 | Rutile | Silica | Methyl hydrogen polysiloxane | 3 7 |
| 12 | 30 | Anatase | None | 3-methacryloxypropyl trimethoxysilane | 3.3 |
| 13 | 15 | Rutile | None | Allyl trimethoxysilane | 3.4 |
| 14 | 35 | Rutile | Silica/ alumina | Carboxyl modified silicone oil | 3.7 |

Example 1

Production of Photoconductor 1

The following steps were performed to produce "a photoconductor 1" having a laminated structure obtained by sequentially forming an intermediate layer, a charge generation layer, and a charge transport layer on an electrically conductive support.

<Formation of Electrically Conductive Support>

A tube made of aluminum alloy having a length of 362 mm was mounted onto a numerically controlled (NC) lathe to perform cutting processing by a sintered diamond bite so as to obtain a tube having an outer diameter of 59.95 mm and a surface roughness ($Rz_{jis}$) of 1.2 μm.

<Formation of Intermediate Layer>

As a binder resin, 100 parts by mass of the following polyamide resin (N-1) was added to 1,700 parts by mass of a mixed solvent of ethanol/n-propylalcohol/tetrahydrofuran (volume ratio: 45/20/35) and mixed and stirred together at 20 degree C. 97 parts by mass of the surface-treated titanium oxide particles 1 and 226 parts by mass of the surface-treated titanium oxide particles 3 were added to the resulting solution. The particles 1 and 2 were dispersed by a bead mill for a mill retention time of 5 hours (the volume ratio of (the titanium oxide particles/resin) was 85/100; the volume ratio of (the titanium oxide particles (1)/the titanium oxide particles (2)) was 3/7). Next, the dispersion liquid was statically left for 24 hours and then filtered to obtain an intermediate layer coating liquid. The filtering was performed under a pressure of 50 kPa using, as a filter, RIGIMESH□ FILTER (manufactured by Pall Corporation) having a nominal filtration rating of 5 μm. The intermediate coating liquid thus obtained was applied by an immersion coating on an outer periphery of the substrate after washing, and then dried at 120 degree C. for 30 minutes to form "an intermediate layer" having a dry film thickness of 2 μm.

Polyamide resin N-1

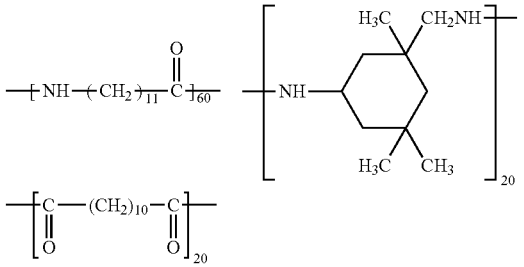

<Formation of Charge Generation Layer>

(Synthesis of CG-1)

Crude titanyl phthalocyanine was synthesized from 1,3-diiminoisoindoline and titanium tetra-n-butoxide. The obtained crude titanyl phthalocyanine was dissolved in sulfuric acid to prepare a solution, and the solution was poured in water to precipitate crystals. The solution was filtered and the resulting crystals were washed well with water to obtain a wet paste. Next, the wet paste was frozen in a freezer and then defrosted, followed by filtration and drying to obtain amorphous titanyl phthalocyanine.

The obtained amorphous titanyl phthalocyanine and (2R, 3R)-2,3-butanediol were mixed together in ortho-dichlorobenzene (ODB) to be an equivalent ratio of (2R,3R)-2,3-butanediol to amorphous titanyl phthalocyanine of 0.6. The obtained mixture was heated while stirring at from 60 to 70 degree C. for 6 hours. The resulting solution was statically left overnight and then, additionally, methanol was added to precipitate crystals. After filtering the solution, the obtained crystals were washed with methanol to obtain a charge generating material CG-1 including an adduct of titanyl phthalocyanine and (2R,3R)-2,3-butanediol.

The X-ray diffraction spectrum of the charge generating material CG-1 was measured and peaks at 8.3 degree, 24.7 degree, 25.1 degree, and 26.5 degree were observed. The obtained charge generating material CG-1 was assumed to be a mixture of a 1:1 adduct of titanyl phthalocyanine and (2R, 3R)-2,3-butanediol and titanyl phthalocyanine (a non-adduct).

(Preparation of Charge Generation Layer Coating Liquid and Formation of Charge Generation Layer)

The following components were mixed together and dispersed using a circulation type ultrasonic homogenizer, RUS-600TCVP (manufactured by Nippon Seiki Seisakusho Co., Ltd.; 19.5 kHz, 600 W) at a circulation flow rate of 40 L/H for 0.5 hours to prepare a charge generation layer coating liquid. The charge generation layer coating liquid was applied on the intermediate layer by the same immersion coating method as the intermediate layer and then dried to form a charge generation layer having a thickness of 0.5 μm.

Charge generating material CG-1: 24 parts

Polyvinyl butyral resin "S-LEC BL-1" (manufactured by Sekisui Chemical Co., Ltd.): 12 parts Solvent, methyl ethyl ketone/cyclohexanone (4/1 (v/v)): 400 parts (Formation of Charge Transport Layer)

The following components were mixed together to prepare a charge transport layer coating liquid. The charge transport layer coating liquid was applied on the charge generation layer by the same immersion coating method as the intermediate layer and then dried to form a charge transport layer having a thickness of 25 μm, thereby obtaining an electrophotographic photoconductor (photoconductor 1).

Charge transporting material: 225.0 parts

Polycarbonate "Z300" (manufactured by Mitsubishi Gas Chemical Company, Inc.: 300.0 parts Antioxidant "IRGANOX 1010" (manufactured by BASF Japan Ltd.). 6.0 parts Tetrahydrofuran/toluene mixed liquid (volume ratio; 3/1): 2000.0 parts Silicone oil "KF-54" (manufactured by Shin-Etsu Chemical Co., Ltd.): 1.0 part The charge transporting material used was a compound below:

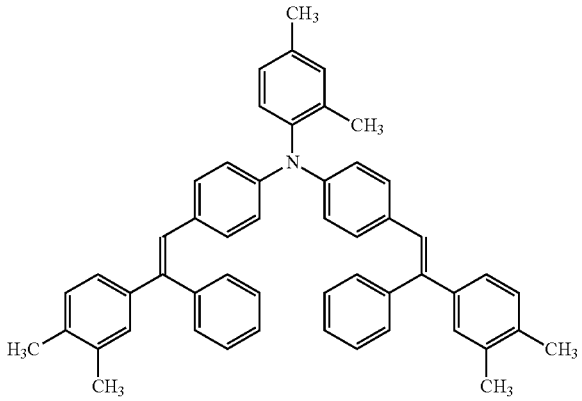

Charge transporting material

Examples 2 to 10

Production of Photoconductors 2 to 10

Electrophotographic photoconductors were produced by the same manner as Example 1, except that the surface-treated titanium oxide particles included in the intermediate layer of the photoconductor 1 were changed as indicated respectively in Table 2.

Comparative Examples 1 to 5

Production of Photoconductors 11 to 15

Electrophotographic photoconductors were produced in the same manner as Example 1, except that the surface-treated titanium oxide particles included in the intermediate layer of the photoconductor 1 were changed as indicated respectively in Table 2.

<Performance Evaluation>

Evaluation was performed using BIZHUB PRO C6501, manufactured by Konica Minolta Business Technologies, Inc., (a tandem type color multifunction printer featuring laser exposure, reversal development, and an intermediate transfer unit) incorporating each of the electrophotographic photoconductors obtained in Examples 1 to 10 and Comparative Examples 1 to 5. Each of the photoconductors was installed in a black image forming position (20 degree C., 50% RH) to print out an A4 image on 300,000 pieces of neutral paper at a coverage rate of each color of yellow, magenta, cyan, and black of 2.5%. Before and after printing out, potential measurement and image evaluation (uneven density and fogging) of each photoconductor were performed as follows. Table 2 below indicates evaluation results thereof.

<Surface Potential (ΔVi) of Electrophotographic Photoconductor>

Before and after printing out the 300,000 pieces of paper (durable printing), each photoconductor was installed in an electrical characteristics measurement apparatus, thereby surface potential changes of the photoconductor were measured. For the measurement, while rotating the photoconductor 130 rpm and in the atmosphere of 10 degree C. and 15% RH, charging and light exposure were repeated under conditions of a grid voltage of 800 V and an exposure amount of 0.5 $\mu J/cm^2$. The potential of the photoconductor after light exposure of the first rotation (initial state) and that of the photoconductor after light exposure of the 65th rotation (after 30 seconds) were measured as Via and as Vib, respectively. Then, the difference of the potentials was calculated (ΔVi=Vib−Via). The evaluation was performed for the value lager than the other. The evaluation standard was as follows, and ranks A to C were classified as acceptable.

A: ΔVi is 10 V or less.

B: ΔVi is more than 10 V to 20 V, and there is no influence on the image.

C: ΔVi is more than 20 V to 30 V, and there is no influence on image formation due to a control device.

D: ΔVi was 30 V or more, and density change in the image is inevitable.

<Image Evaluation>

Each photoconductor was installed in the black image forming position of BIZHUB PRO C6501, manufactured by Konica Minolta Business Technologies, Inc., (the tandem type color multifunction printer featuring laser exposure, reversal development, and an intermediate transfer unit) to perform the following image evaluations under conditions of 30 degree C. and 80% RH.

1) Uneven Density

Figure 2:
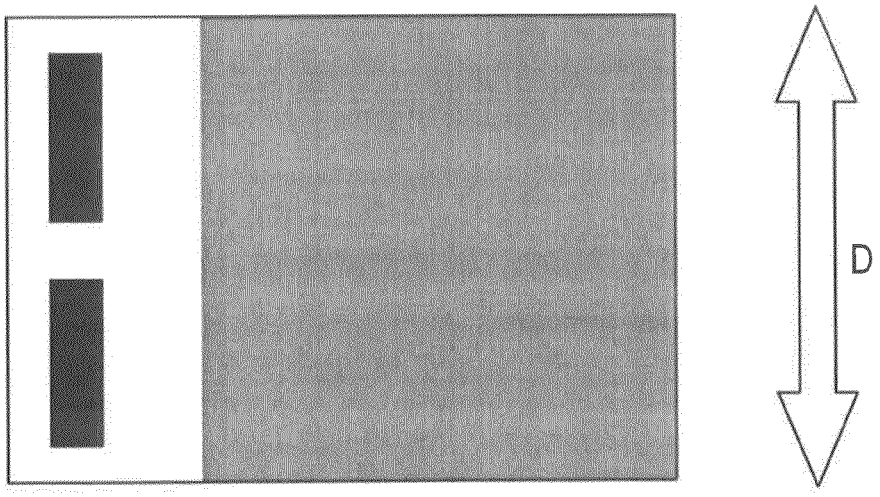
FIG. 2 is a view illustrating a chart for image evaluation in Examples.

Each electrophotographic photoconductor obtained was placed in the position of black (BK). Then, a chart indicated in FIG. 2 was output by changing at a transfer current in a range from 20 μA to 100 μA. In FIG. 2, the letter "D" represents a rotation axis direction of the electrophotographic photoconductor. Using a transfer material "POD GLOSS COAT (size: A3, 100 $g/m^2$)" (manufactured by Oji Paper Co., Ltd.), an image formed on the transfer material was visually observed. Image uneven density was evaluated based on the following criteria, and ranks A to C were determined as acceptable.

A: Even at a transfer current of 60 μA or more, no uneven density is observed.

B: At a transfer current of 60 μA or more, slight uneven density is observed but acceptable for practical use.

C: At a transfer current of from 40 to 50 μA, slight uneven density is observed, but acceptable for practical use (whereas unacceptable in the formation of high quality images).

D: Even at less than a transfer current of 40 μA, obvious uneven density is observed and unacceptable for practical use.

2) Fogging (Sensory Evaluation)

Each electrophotographic photoconductor obtained was placed in the position of black (BK). A transfer material with no image formed thereon ("POD GLOSS COAT (size: A3, 100 g/m$^2$)" (manufactured by Oji Paper Co., Ltd.) was prepared and conveyed to the position of black to form a blank image (a solid white image) under conditions of a grid voltage of 800 V and a developing bias of 650 V. Then, the presence or absence of fogging on the obtained transfer material was evaluated. Then, a solid yellow image was formed in the same manner as above under the conditions of a grid voltage of 800 V and a development bias of 650 V to evaluate the presence or absence of fogging on the obtained transfer material. The presence or absence of fogging was evaluated based on the following criteria, and ranks A and B were determined as acceptable.

A: No fogging is present.

B: Slight fogging is observed when enlarged, but acceptable for practical use.

C: Slight fogging is visually observed and unacceptable for practical use (NG).

D: Fogging is noticeable (NG).

TABLE 2

| | Photo-receptor No. | First titanium oxide particles (1) No. | First titanium oxide particles (1) Amount of addition (parts by mass) | Second titanium oxide particles (2) No. | Second titanium oxide particles (2) Amount of addition (parts by mass) | Particle volume ratio (1):(2) | Evaluation results ΔVi | Evaluation results Density unevenness | Evaluation results Fogging |
|---|---|---|---|---|---|---|---|---|---|
| Ex. 1 | 1 | 1 | 97 | 3 | 226 | 3:7 | B | B | A |
| Ex. 2 | 2 | 1 | 129 | 5 | 179 | 4:6 | B | A | A |
| Ex. 3 | 3 | 1 | 129 | 8 | 173 | 4:6 | A | A | A |
| Ex. 4 | 4 | 7 | 145 | 8 | 145 | 5:5 | B | A | B |
| Ex. 5 | 5 | 1 | 129 | 10 | 153 | 4:6 | B | B | B |
| Ex. 6 | 6 | 1 | 194 | 12 | 112 | 6:4 | A | A | B |
| Ex. 7 | 7 | 6 | 122 | 3 | 173 | 4:6 | B | B | B |
| Ex. 8 | 8 | 11 | 126 | 8 | 173 | 4:6 | A | B | B |
| Ex. 8 | 9 | 6 | 184 | 3 | 129 | 6:4 | B | B | B |
| Ex. 10 | 10 | 4 | 119 | 8 | 173 | 4:6 | B | A | B |
| Comp Ex. 1 | 11 | 1 | 323 | — | 0 | 1:0 | D | C | A |
| Comp Ex. 2 | 12 | 9 | 281 | — | 0 | 1:0 | A | B | D |
| Comp Ex. 3 | 13 | 1 | 97 | 6 | 214 | 3:7 | D | C | B |
| Comp Ex. 4 | 14 | 1 | 127 | 13 | 170 | 4:6 | B | C | C |
| Comp Ex. 5 | 15 | 14 | 126 | 8 | 170 | 4:6 | C | C | C |

As indicated in Table 2 above, in the electrophotographic photoconductors of Examples 1 to 10 using the two kinds of titanium oxide particles surface-treated with the different reactive organic silicon compounds in the intermediate layer, it was found that the surface potentials ΔVi were low as 30 V or less, and thus electrical stability was maintained, as well as the occurrence of both uneven density and fogging was suppressed. Meanwhile, Comparative Examples 1 to 3 resulted in as follows: Comparative Examples 1 and 2 using the single kind of particles in the intermediate layer and Comparative Example 3 using the two kinds of particles surface-treated with the same surface treatment agent in the intermediate layer were not able to maintain electrical stability of the electrophotographic photoconductor, and thus suppression of both uneven density and fogging was not be simultaneously achieved.

What is claimed is:

1. An electrophotographic photoconductor comprising an intermediate layer, and a photosensitive layer that are formed on an electrically conductive support, the intermediate layer comprising:

first titanium oxide particles surface-treated with an inorganic oxide and a first reactive organic silicon compound, the first reactive organic silicon compound being methyl hydrogen polysiloxane;

second titanium oxide particles surface-treated only with a second reactive organic silicon compound different from the first reactive organic silicon compound, the second reactive organic silicon compound being a compound represented by the following general formula (1):

$$R—Si—(X)_3 \quad (1)$$

wherein R represents a alkyl group having 1 to 10 carbon atoms substituted by at least one of acryloxy and methacryloxy groups or unsubstituted; and X represents an alkoxy group having 1 to 4 carbon atoms or a halogen atom; and a binder resin.

2. The electrophotographic photoconductor as claimed in claim 1, wherein the second reactive organic silicon compound is 3-methacryloxy propyl trimethoxysilane or 3-acryloxy propyl trimethoxysilane.

3. The electrophotographic photoconductor as claimed in claim 2, wherein the second reactive organic silicon compound is 3-methacryloxy propyl trimethoxysilane.

4. The electrophotographic photoconductor as claimed in claim 1, wherein the inorganic oxide is at least one of silica and alumina.

5. The electrophotographic photoconductor as claimed in claim 1, wherein the binder resin is polyamide resin.

6. An image forming apparatus comprising multiple image forming units for each of yellow, cyan, magenta, and black images, each of which contains the electrophotographic photoconductor as claimed in claim 1; an endless belt-shaped intermediate transfer unit; a paper conveying means for conveying paper to the image forming unit; and a fusing means for fusing a toner onto the paper.

* * * * *